United States Patent [19]

Davis

[11] 4,068,432

[45] Jan. 17, 1978

[54] MOVABLE PARTITION WALL

[75] Inventor: Donald A. Davis, Winchester, Mass.

[73] Assignee: The Schwamb Corporation, Arlington, Mass.

[21] Appl. No.: 710,132

[22] Filed: July 30, 1976

[51] Int. Cl.[2] ..... E06B 1/04

[52] U.S. Cl. ..... 52/205; 52/241

[58] Field of Search ..... 52/241, 242, 243, 479, 52/481, 213, 205

[56] References Cited

U.S. PATENT DOCUMENTS

| | | | |
|---|---|---|---|
| 3,487,598 | 1/1970 | Lopina | 52/241 X |
| 3,533,205 | 10/1970 | Pestel et al. | 52/481 X |
| 3,593,475 | 7/1971 | LaGue | 52/241 |
| 3,745,732 | 7/1973 | Pritchard et al. | 52/241 X |
| 3,755,979 | 9/1973 | Pantazi | 52/241 X |
| 3,861,103 | 1/1975 | Rasmussen | 52/241 |

*Primary Examiner*—Price C. Faw, Jr.
*Assistant Examiner*—Carl D. Freidman
*Attorney, Agent, or Firm*—Beall & Jeffery

[57] ABSTRACT

A demountable partition wall is of studless construction and comprises ceiling and floor runners adapted to receive a pair of wall panels in spaced relation. The ceiling and floor runners include leg portions which frictionally receive the wall panels to provide a stable and sound deadening construction at the mounting ends of the panels. A stabilizing and sound dampening pad assembly is preferably located in the vertically intermediate regions of the wall. Doors and window units can be located as desired along the partition wall, with the window and door frames being adaptable to the ceiling and floor runners. The floor runner can be spaced above the floor or supporting surface by nails or the like thereby permitting the wall to be installed over carpeting without damaging the same. The studless, open interior of the wall permits service equipment such as wiring, piping and the like to be located where necessary along the wall, and the wall can be quickly and easily assembled and disassembled for relocation if desired.

19 Claims, 9 Drawing Figures

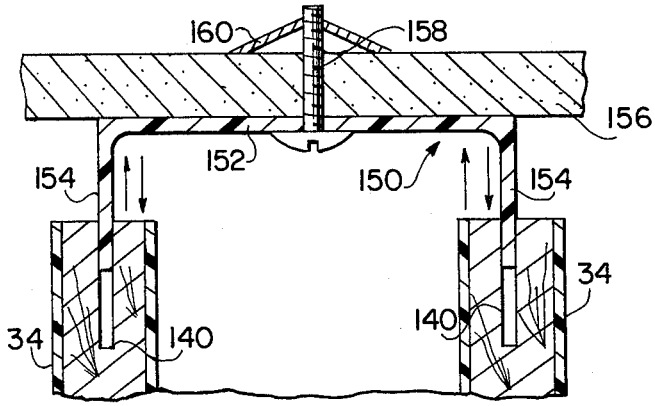
FIG. 8
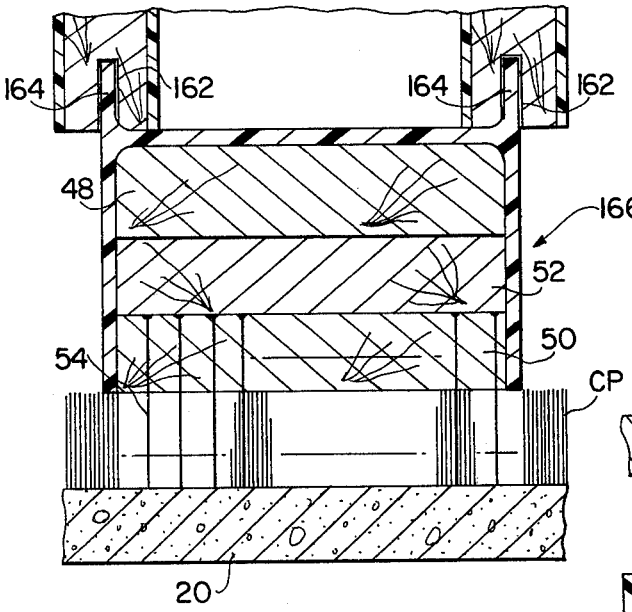
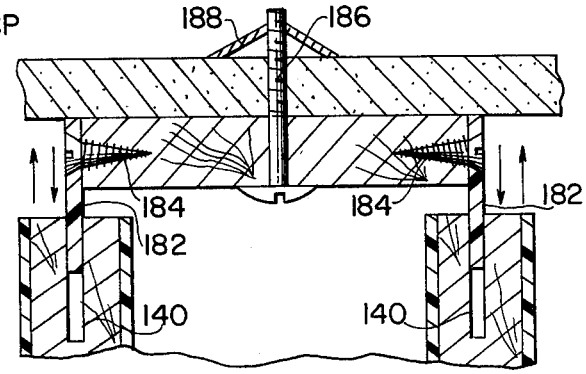
FIG. 9
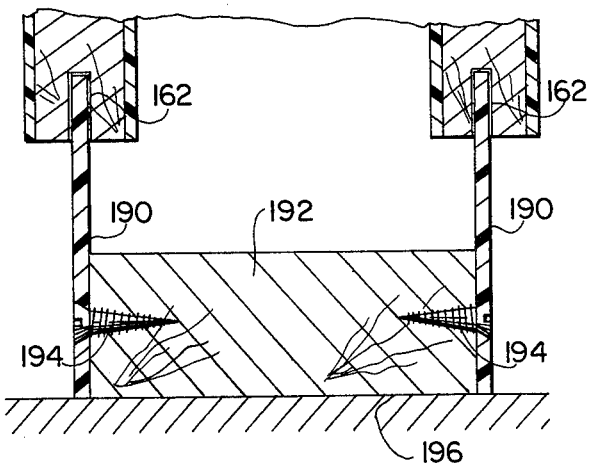

MOVABLE PARTITION WALL

BACKGROUND OF THE INVENTION

The present invention relates as indicated to a movable partition wall, and relates more particularly to improvements in partition assemblies disclosed and claimed in U.S. Pat. No. 3,755,979, granted Sept. 4, 1973 to Spiros G. Pantazi, entitled "Demountable Partition Assembly", and my pending application Ser. No. 588,837, filed June 20, 1975, and entitled "Movable Partition Wall".

The partition assemblies disclosed in the aforementioned patent and pending application generally meet the desired objectives of providing a partition which can be quickly and easily assembled and disassembled between the floor and ceiling of a room and which is designed to minimize heat and sound transmission through the partition assembly. A further feature common to the prior partition assemblies as well as the partition wall in accordance with the present invention is the provision of substantial space between the walls which form the exterior sides of the partition thereby to facilitate the location of service equipment, such as piping, wiring, ducts and the like, as well as providing a vertical studless partition construction, the significance of which will be well recognized by those in the art. By eliminating vertical studs or a solid block wall construction, manufacturing and installation costs are substantially reduced.

Although the partition assemblies disclosed in the above noted patent and my pending application meet the above noted objectives, the construction costs of both partition assemblies are relatively high which has somewhat impaired the ability to commercialize the partition assemblies on a competitive basis. In certain instances, the feature of movability is not a significant factor, and as a result the systems must compete commercially with the normal stud-type wall construction. Where movability is a significant feature for the user, there are numerous movable wall partitions which are commercially available and competitive in price. However, the movable partition walls currently on the market do not satisfactorily provide the desired combined characteristics of sound dampening, strength, stability, ease of application and service containment.

SUMMARY OF THE INVENTION

The present invention provides a movable partition wall which can be quickly and easily assembled and disassembled between the floor and ceiling of a room and which possesses excellent sound dampening, strength and stability characteristics. In accordance with the invention, the bottom support structure for the partition wall extends continuously the length of the wall thereby providing improved sound dampening in such region as well as enhancing the strength and stability of the partition wall at the bottom thereof.

A further feature of the invention resides in the provision of ceiling and floor runners which are constructed and arranged to tightly receive the wall panels which can be quickly and easily mounted within the runners. Both the ceiling and floor runners are preferably formed of plastic material or extruded aluminum and are constructed and arranged to tightly and resiliently receive the panels. The spacing between the base portions of the runners and the vertical dimension of the wall panels are such that the panels can be initially raised upwardly into the ceiling runner and thereafter dropped into the spaces provided therefor in the floor runner. The resilient mounting of the wall panels at both the upper and lower ends thereof in the preferred form of the invention is provided by inner leg portions of the ceiling and floor runners which are resilient and engage the adjacent side walls of the panels. In an alternative form of the invention, the vertical positioning and mounting of the wall panels can be effected by providing centrally located slots in the upper and lower edges of the wall panels, which slots engage the outer leg portions of the ceiling and floor runners, with this arrangement likewise permitting easy installation of the wall panels.

A still further feature of the invention is to provide a support assembly for the bottom of the partition which provides stable support for the assembly while at the same time minimizing lateral shifting of the assembly once in place. The support system is particularly adapted for installation over carpeting, with the main supporting components for the partition being spaced above the carpeting and supported from the floor by means of nails or the like which extend through the bottom support member into engagement with the floor. This arrangement minimizes damage to the carpet in the event the partition is relocated, while at the same time providing the necessary strength and resistance to lateral shifting of the partition thereby providing a very stable arrangement. The floor runner is constructed so as to inherently provide exposed side or leg portions which extend down to the carpet line thereby avoiding the need for additional base or finish members as is normally the case in wall partitions of this general type. Where carpeting is not present, suitable securing means, for example, tape having an adhesive coating on both sides, can be provided for containment of the bottom supporting member on the floor.

Another feature of the present invention is the adaptability of the essential features of the partition wall to the inclusion of doors or windows mounted along the partition wall. The necessary framing structure for the doors or windows can quickly and easily be assembled on and supported from the ceiling and floor runners without requiring modification of the runners, which is a significant feature and advantage in adapting the wall assembly to particular customer design.

These and other objects of the invention will appear as the following description proceeds in particular reference to the application drawings.

BRIEF DESCRIPTION OF THE APPLICATION DRAWINGS

FIG. 8 is a fragmentary sectional view of a further modified form of the invention, and FIG. 9 is a fragmentary sectional view of another modification in accordance with the present invention.

DETAILED DESCRIPTION OF THE PREFERRED EMBODIMENTS

Figure 1:
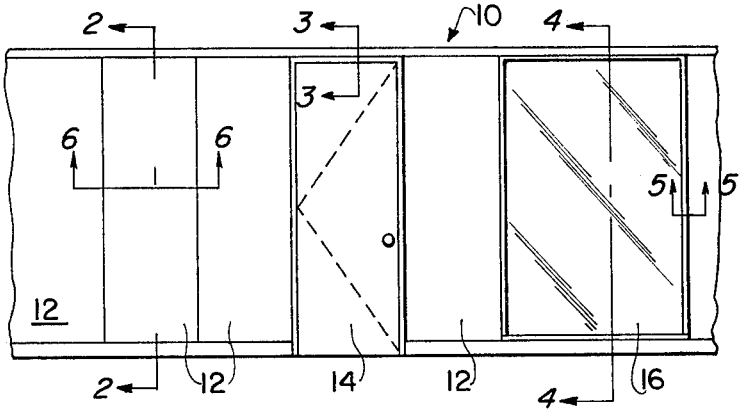
FIG. 1 is a fragmented front elevational view of a movable partition wall constructed in accordance with the present invention.

Referring now in more detail to the application drawings, in which like parts are indicated by like reference numerals, and initially to FIG. 1, the movable partition wall constructed in accordance with the present invention is generally indicated at 10 and in the form shown comprises wall panels commonly designated at 12, a door 14, and a window 16. As will be apparent as the following description proceeds, the partition wall constructed in accordance with the invention can consist entirely of wall panels, or any combination of wall panels, doors or windows, and the arrangement shown in FIG. 1 is intended to depict a typical assembled wall segment. The width of the wall panels 12, door 14 and window 16 can be selected as desired, and to facilitate use of commercially available wall panels and doors, these members can if desired be commercially obtained and of standard dimension.

Figure 2:
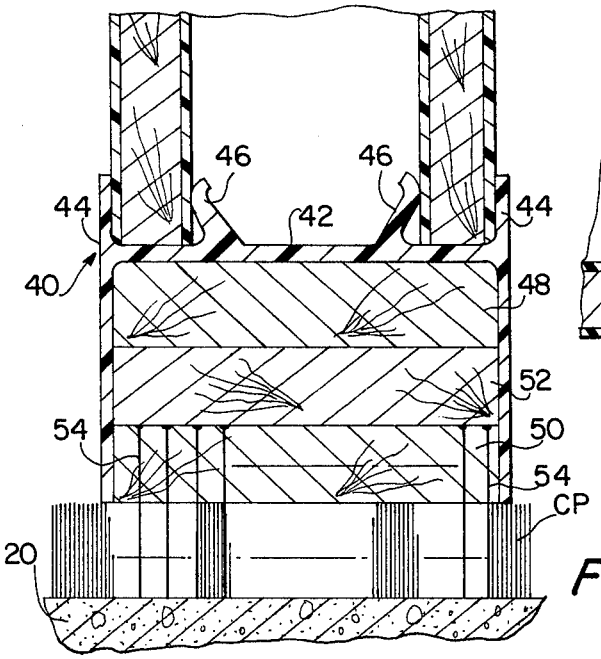
FIG. 2 is a fragmentary vertical cross-sectional view taken on line 2—2 of FIG. 1.

Referring to FIG. 2, the room space in which the partition wall is to be mounted is defined vertically by the ceiling 18 and the supporting floor 20. A ceiling runner generally indicated at 22 is securely mounted to the ceiling 18 by means of a mounting bolt 24 which extends through the ceiling 18 and is retained by fastener 26 or the like. The ceiling 18 may be a dropped ceiling, drywall, or any other suitable commercial material.

The ceiling runner 22 includes a base portion 28 which is generally flat and disposed contiguous the adjacent surface of the ceiling 18, downwardly depending outer legs commonly designated at 30, and downwardly and outwardly inclined inner legs commonly designated at 32. The celing runner is preferably formed of plastic or extruded aluminum so as to provide the desired resiliency in the inner leg portions 32 to permit such leg portions and the adjacent outer legs to snugly receive the wall panels when inserted therebetween. The normal spacing between each outer leg 30 and the end of each adjacent inner leg 32 is slightly less than the thickness of the wall panel whereby the inner leg 32 is forced inwardly of the ceiling runner, with the resilient construction of the legs 32 thereby providing a tight fit with the wall panels. This construction not only provides the desired stability for the upper mounting of the walls but substantially reduces the sound transmission through such region by virtue of the resilient construction of the ceiling runner. The ceiling runner 22 preferably extends continuously along the surface of the ceiling, which, in most current commercial construction, is dropped.

Figure 7:
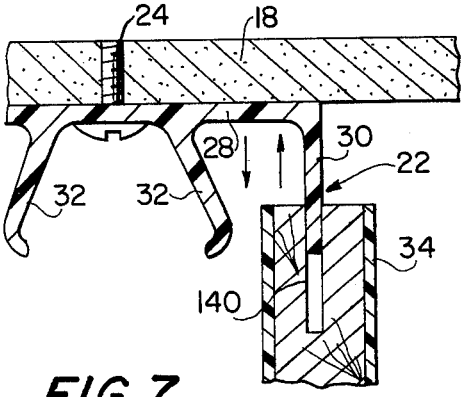
FIG. 7 is a fragmentary sectional view showing an alternative form of supporting and positioning the wall panels relative to the ceiling and floor runners.

The wall panels are commonly designated at 34 and in the form shown are of laminate construction, having a solid wood interior 36 and plastic outer laminates 38. It will be understood that other material can be used for the panels, for example, solid polymers having a decorative surface or surfaces. In the mounting shown in FIG. 1, the thickness of the wall panels 34 are compatible with the spacing between the outer legs 30 and inner legs 32, and it will be apparent that the wall thickness and leg spacing can be chosen as desired. FIG. 7, which will be referred to in more detail hereinbelow, illustrates a mounting arrangement for the wall panels which facilitates the use of wall panels of greater thickness than normally provided by the spacing of the outer and inner legs of the ceiling runner.

Referring to the lower portion of FIG. 2, a floor runner is generally indicated at 40 and in essential respects is constructed similar to the ceiling runner 22. The floor runner thus includes a base portion 42, outer legs commonly designated at 44 and inner legs commonly designated at 46. The floor runner 40 differs from the ceiling runner in that the legs 44 are vertically more extensive, extending in the form shown down to the top of the upper surface of the carpeting CP.

The floor runner 40 is supported from the floor 20 by a leveling block 48 which is positioned within the runner below the base 42 and by a floor strip 50 which is disposed below the leveling block and immediately above the upper surface of the carpet, or resilient tile floor. In the form shown a shim block 52 is positioned between the leveling block 48 and the floor strip 50 in order to properly level the partition at spaced intervals. It will be apparent that shimming is not only desirable but in many instances necessary to provide an absolutely level supporting surface for the partition wall. The floor strip may be continuous or in spaced segments along the partition, as desired.

In the form shown where carpeting is present, the floor strip 50 is supported from the floor 20 by means of nails 54 which extend downwardly through the floor strip into engagement with the floor surface. The nails 54 in the necessary amounts and at the necessary spaced intervals support the floor strip in a stable manner from the floor 20, with the penetration of the nails through the carpet serving the further function of providing lateral stability against shifting of the partition walls. An important feature of the invention is the ability to install the partition wall after the carpet has been laid, without damage to the carpet.

To install the bottom support assembly for the partition, the floor strip 50 is initially laid down, with the floor strip being preformed with the penetrating nails, and the leveling block 48 positioned over the floor strip. The workable vertical dimension between floor and ceiling is then established and shims as shown at 52 are then provided as necessary to level the support assembly parallel to the ceiling. The floor runner 40 is then positioned over the floor strip 50, the leveling block 48, and the shims 52. It will be understood that the floor strip 50 and thus the floor runner 40 are vertically aligned with the ceiling runner 22.

A pressure pad assembly generally indicated at 60 is mounted on one of the wall panels 34, the one shown at the left in FIG. 2, and comprises a block 62 which can be secured to the panel by mounting screws commonly designated at 64. The block 62 could also be adhesively bonded to the panel. Prior to such mounting, a pad holding block 66 is secured to the block 62 by a fastening screw 68, with the pressure pad 70 being mounted in the block 66. The pad 70 as shown in FIG. 2 is constructed of compressible and resilient material, for example foam rubber or the like, and is adapted to engage the adjacent face of the opposed wall panel 34 as shown in FIG. 2. In this manner sound transmission through the vertically intermediate areas of the wall panels is minimized, and the pressure pad assembly serves the further important function of providing a stable spacing of the wall panels in the intermediate regions thereof. Pressure pad assemblies can be mounted on every panel or on alternate panels as desired and as necessary depending upon the environment in which the partition wall is to be used. The pressure pad assembly preferably extends longitudinally substantially the entire length of each panel or panels.

The manner in which the wall panels 34 are mounted in the ceiling and floor runners should be apparent from the above description. After the ceiling runner has been installed and the floor runner and supporting assembly therefor installed, the wall panels 34 can be mounted at their upper and lower ends between the outer and inner legs of the runners as shown. In order to clear the floor runner, each wall panel can be raised upwardly within the space between the outer and inner leg in the ceiling runner, as indicated by arrows in FIG. 2, until the lower end of the wall panel is aligned with the outer and inner leg of the floor runner. The wall panel can then be lowered so that the bottom edge of the panel contacts the upper surface of the base 42 of the floor runner. The spacing of the floor and ceiling runner is such that the resilient inner leg of both runners firmly, resiliently engage the wall panels at the upper and lower ends thereof. When the wall panels 34 are assembled, the construction and arrangement of the pressure pad assembly 60 automatically provides the resilient bridging between the panels thereby to dampen the sounds in such region.

Figure 6:
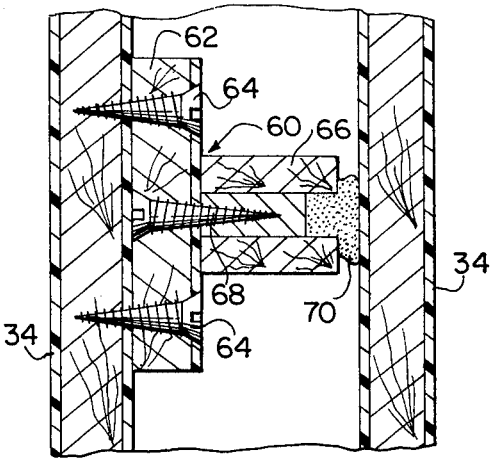
FIG. 6 is a fragmentary sectional view taken along line 6—6 of FIG. 1.
Figure 6:
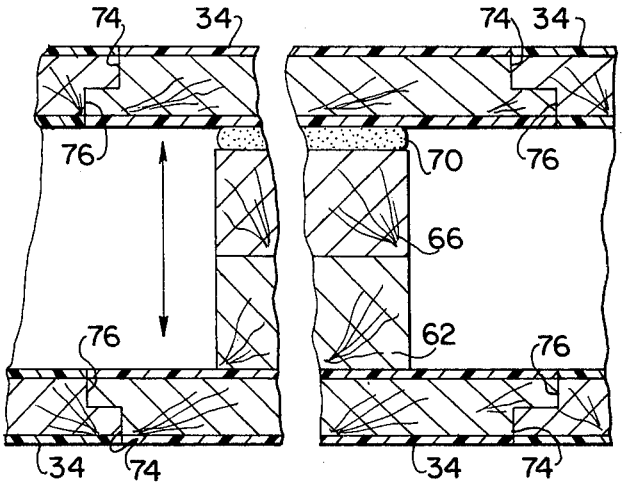

Referring to FIG. 6, each wall panel is notched along the side edges thereof to provide a shiplap-type assembly, with such construction providing a continuous exterior wall surface with barely visible interruption. As shown in FIG. 6, the central panel section is provided with grooves 74, and the adjoining sections are provided with grooves 76 by means of which the lateral edges can be easily mated. It will be noted that the pressure pad assembly serves to provide a tight fitting of the mating surfaces of the adjacent panels.

Figure 3:
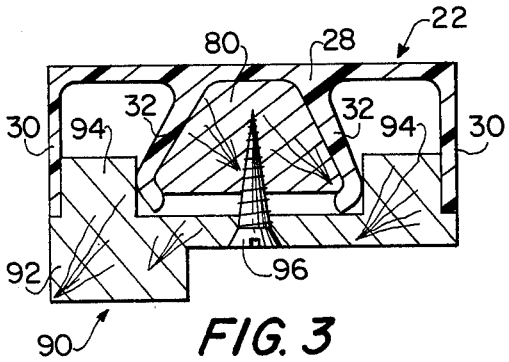
FIG. 3 is a sectional view taken on line 3—3 of FIG. 1.

As noted above, an important feature of the present invention resides in the adaptability of the partition wall to receive windows and doors which can be quickly and easily installed in or removed from the wall at any desired spacing therealong. The door 14 forms part of the partition wall shown in FIG. 1, and FIG. 3 is a sectional view through the mounting of the door header on the ceiling runner. For purposes of clarity, the ceiling 18 has not been shown in FIG. 3. Mounted within the generally parallelogram shaped opening defined by the inner legs 32 and the base 28 is a header block 80 of similar shape. The block 80 snaps into the opening due to the resiliency of the lower end portions of the inner leg members, which retain the block in place. The block is of a length to satisfactorily secure the door header in place at the opening for the door.

The door header is generally located at 90 and includes a main body portion 92 and upwardly extending projections commonly designated at 94. The projections extend upwardly into the spaces defined by the outer legs and inner legs as above explained with reference to the wall panels, with the projections 94 being tightly received therebetween. The positioning of the projections 94 between the legs also serves to prevent withdrawal of the header block 80 from the position thereof shown in FIG. 3. The door header 90 is formed with notches at the outer edges thereof and a central recess which engage the runner and thereby serve to limit the upward movement of the door header into the ceiling runner. Once the door header is positioned as shown in FIG. 3, a mounting screw 96 is driven through the door header into the header block 80 for retaining the door header on the ceiling runner. It will be understood that the door header 90 will be of sufficient length to accommodate the door size, in a well known manner, and the header block 80 can either be continuous or provided in short sections for securing the door header to the ceiling runner.

Figure 4:
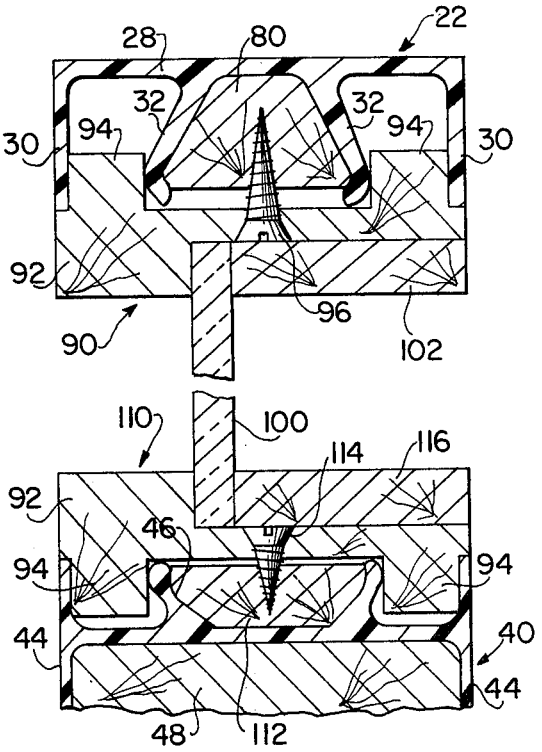
FIG. 4 is a fragmentary sectional view taken on line 4—4 of FIG. 1.

FIG. 4 is a fragmentary vertical sectional view showing the window header and base, with the header being constructed identically to the door header shown in FIG. 3. The same reference numerals have accordingly been applied. The window pane is shown at 100, and an upper stop member 102 is provided to maintain the pane in the mounted position. The window stop 102 can be secured to the window header 90 in any desired manner (not shown).

The window base is generally indicated at 110 and is constructed similarly to the window header 90, comprising a main body portion 92 and downwardly depending projections 94 which extend into the spaced between the outer and inner legs of the floor runner 40. A base block 112 is mounted between the inner legs as above described, and the window base 110 is mounted thereto by a mounting screw 114. A window stop 116 is provided for securely mounting the window pane 100 at the bottom thereof.

Figure 5:
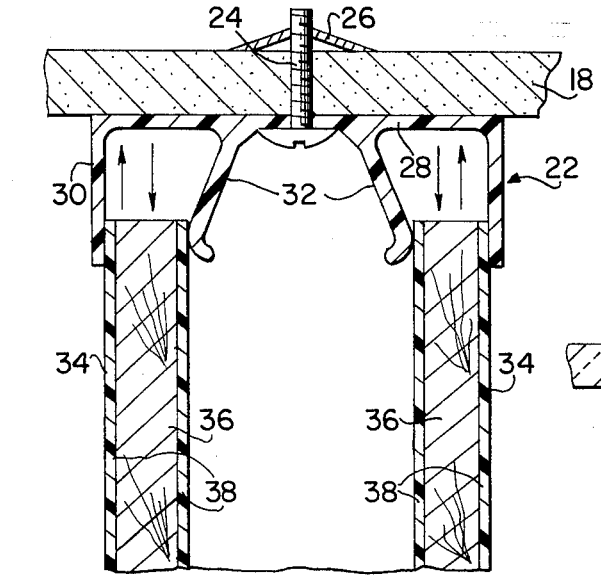
FIG. 5 is a sectional view taken along line 5—5 of FIG. 1.
Figure 5:
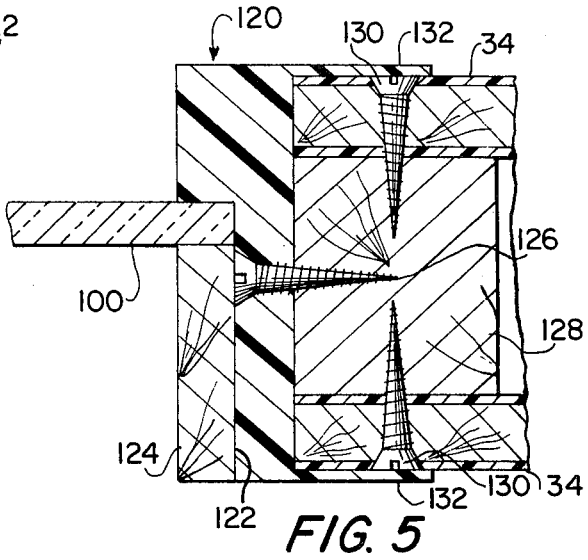

Referring to FIG. 5, which comprises a sectional view taken on line 5—5 of FIG. 1, a window jamb generally indicated at 120 receives the side edge of the window pane 100, with the jamb 120 being notched as shown at 122 to receive the window stop shown at 124. The jamb 120 is rigidly connected to the adjacent wall panels 34 by means of mounting screws 126 which are secured to a spacing block 128, the width of which corresponds to the desired spacing of the wall panels. The adjacent ends of the wall panels 34 are likewise secured to the spacing block 128 by means of mounting screws commonly designated at 130. Finish or trim members designated at 132 are preferably provided and extend vertically along the edge of the wall panels to overlie the mounting screws 130 for decorative purposes.

It will thus be seen, referring to FIGS. 4 and 5, that a window can be easily assembled in the partition wall with no modification to the ceiling or floor runners, and with minimal effort. The window header and base are secured to the ceiling and floor runners, and the window jambs are secured to the adjacent ends of the wall panels 34 as shown in FIG. 5. Although only one jamb is shown in FIG. 5, it will be apparent that the opposite window jamb is constructed and mounted in the same manner. The corners of the window jamb 120 and the window header and base are preferably interconnected by mitering the corners thereof in known manner.

Although only a window jamb has been shown (FIG. 5) the door jamb is of similar construction and provided at both sides of the door opening. As explained above, the door jambs and door header are mitered at the corners thereof for interconnecting the door frame assembly. Since the door 14 extends substantially to the upper surface of the carpeting, the floor runner terminates at each side of the door opening. The door can be hinged in any well known manner, for example, by means of the spacing blocks 128 which are provided at both sides of the door opening.

There is shown in FIG. 7 an alternative arrangement for mounting the wall panels to the ceiling and floor runners. Although only the ceiling runner 22 is illustrated in the fragmentary FIG. 7 view, it will be understood that the bottom of the wall panel is mounted on the floor runner in the same manner, as shown in FIG. 8. The same reference numerals have been used in FIG. 7 for structure which also appears in FIG. 1.

In FIG. 7, the wall panel 34 is formed in the upper end thereof with a vertically extending notch 140 the upper end of which terminates at the upper edge of the panel. The notch or groove 140 is continuous and of a width to receive the associated outer leg 30 of the ceiling runner 22. It will be understood that a similar notch appears in the lower end of the wall panel 34 for similar engagement with the outer leg 30 of the floor runner. To facilitate the mounting of the panel between the ceiling and floor runners as above described, the upper notch 140 shown in FIG. 7 is substantially longer than the bottom notch which receives the outer leg of the floor runner to permit the wall panel 34 to be moved upwardly so that the bottom edge of the panel can clear the outer leg of the floor runner to permit the groove in the wall panel to be aligned with such outer leg. The wall panel can thereafter be dropped whereby both the bottom and top of the wall panel are supported by the outer legs of the runners which extends into the grooves formed in the panel.

The advantage of the FIG. 7 arrangement is that both the ceiling and floor runners are capable of receiving wall panels of greater thickness than the spacing of the outer and inner legs would otherwise provide. For example, if the spacing of the central and adjacent outer legs of both runners is such as to accommodate wall panels having a thickness of ½ inch, wall panels having a thickness of ¾ inches cannot be accommodated. By mounting the panel in the manner as shown in FIG. 7, such thicker panels can be accommodated without having to replace either the ceiling or floor runners. The wall panel mounting in FIG. 7 also provides an esthetic design change as contrasted to the otherwise flush wall surface.

It will be apparent that in the FIG. 7 panel mounting arrangement, the inner legs 32 of both the ceiling and floor runners are not necessary. The present invention therefore contemplates modifying both the ceiling and floor runners to include only the base and the outer legs. In such arrangement the bottom supporting assembly can remain the same and the pressure pad assembly can also be employed to advantage for the reasons indicated.

In such modified ceiling and floor runner construction, referring to FIG. 8, the ceiling runner, generally indicated at 150, comprises a base portion 152 and downwardly depending legs commonly designated at 154. The ceiling runner is secured to the ceiling 156 by a mounting bolt 158 and a fastener 160 as previously described. The wall panels 34 are constructed as above described in connection with the FIG. 7 form, each panel being formed with a groove 140 in the upper edge thereof. A similar groove 162, although not as deep, is formed in the bottom edge of each panel 34 for receiving the upper ends 164 of the floor runner generally indicated at 166. The floor runner is supported from the floor 20 above the carpet CP in the same manner as shown in FIG. 2, and like reference numerals have accordingly been applied in FIG. 8.

Although not shown in the fragmentary FIG. 8 view, a pressure pad assembly similar to that shown in FIG. 2 is preferably provided to stabilize and sound dampen the vertically intermediate regions of the partition.

The ceiling runner 150 and floor runner 166 are preferably formed either of plastic material or extruded aluminum, and the material must be sufficiently resilient to provide flexure of the bottom portions of the legs 154 to initiate the mounting of the panels. As above noted, the grooves in the upper edges of the wall panels are deeper than the bottom grooves 162 to permit the legs 154 to be received in the grooves 140 and the panels moved upwardly until the bottom edges thereof clear the legs 164 of the floor runner after which the legs can be aligned with the grooves 162 and the panels lowered in place. The width of the grooves 140 and 162 is only slightly larger in dimension than the thickness of the legs 154 and 164 thereby to provide a reasonably tight fit of the wall panels in the ceiling and floor runners. As previously described, the floor strip 50, leveling block 48 and shims 52, if necessary, are initially installed to provide an upper surface level with the ceiling, before the floor runner 166 is mounted thereon.

It will be noted that in the FIG. 8 form of the invention, as in FIG. 7, wall panels of varying width can be received without modifying either the ceiling or floor runners. This is a decided advantage in the adaptability of the system to varying partition designs. In addition, the FIG. 8 form of the invention possesses all of the other advantages of the partition assembly previously described, including excellent sound dampening characteristics, a studless and entirely open interior except for the pressure pad assembly, and the stable mounting of the assembly at the top and bottoms thereof as well as in the intermediate portion thereof by virtue of the pressure pad assembly.

Referring to FIG. 9, there is illustrated therein an even more simplified version of the invention in which the ceiling runner comprises a separate ceiling plate 180, normally constructed of wood, and separate legs commonly designated at 182 which are secured to the plate by screws 184. The plate 180 is mounted on the ceiling in the same manner as previously described, by means of a mounting bolt 186 and a fastener 188. As in the FIGS. 6 and 7 forms of the invention, the wall panels 34 are formed with grooves 140 for receiving the legs 182, and the grooves 140 are of greater depth than the grooves 162 formed in the bottom edges of the panels.

The wall panels are supported at their lower ends in FIG. 9 by means of legs 190 which are rigidly secured to a floor runner 192 by means of mounting screws 194. The floor runner 192 as shown can be mounted directly on the supporting surface 196 in any suitable manner such as by adhesive bonding, nails, other type fasteners, or the like. The supporting arrangement shown in FIG. 9 is particularly adaptable to installation of the partition wall over non-carpeted surfaces, and in the event the partition wall of FIG. 9 is desired to be mounted over carpeted surfaces, the bottom support assembly previously illustrated and described can be employed. Thus, the floor runner 192 could be modified to be preformed with nails as shown in FIGS. 2 and 8 to elevate the strip from the supporting surface, and the legs 190 would likewise terminate at the carpet line.

Although not shown in FIG. 9, it will be understood that a pressure pad assembly of the type shown in FIG. 2 is preferably used in this form as well in order to stabilize and sound dampen the intermediate regions of the partition wall. The mounting of the wall panels 34 is effected in generally the same manner previously described in connection with FIG. 8, and the grooves 140, 162 and legs 182 and 190 are dimensioned so as to provide a closely fitting engagement of the panels in order to stabilize the mounting. The legs 182 must be resilient to some extent to permit the lower ends thereof to flex to receive the upper ends of the grooves 140 during the panel installation. It will be understood that the thickness of the ceiling plate 180, the vertical dimensions of the legs 182 and the depth of the grooves 140 will be chosen so as to provide a rigid top mounting for the partition wall and permit easy installation of the wall panels through engagement of the lower ends of the legs 182 in the grooves 140.

It will be noted that in the FIG. 9 form of the invention, the floor runner 192 follows the contour of the floor 196 and is thus not in all instances parallel to the ceiling. Thus, the bottom of adjacent wall panels, the elevation of which is controlled by the top edges of the legs 190 engaging the bottom of the grooves 162, may not be precisely level in longitudinally adjacent pairs of panels. If the unevenness of the floor is excessive, the floor runners 192 can be shimmed where necessary to level the support as necessary.

In FIG. 9, the ceiling plate 180 and the floor runner 192 can be provided in continuous form or in strips, and the legs 182 and 190 extend preferably continuously longitudinally of the partition. The wall panels in both these FIGS. 8 and 9 forms of the invention can be grooved at their lateral edges as shown in FIG. 6 to provide a tight connection at the joints thereof. The headers for any doors or windows, and the base for the windows, can be modified as necessary for mounting on the ceiling plate 180 and the floor runner 192.

It will thus be seen that the FIG. 9 form of the invention similarly provides a partition wall which can be easily installed or demounted, and which is studless and entirely open interiorly except for the pressure pad assembly. Due to the mounting of the panels at their top and bottom ends and the pressure pad assembly, the wall possesses excellent sound dampening characteristics, and service items such as piping, wiring and the like can easily be positioned between the wall panels 34.

It will thus be seen that the above noted objectives of the present invention have been achieved. In all forms of the invention, a partition wall is provided which is simply and economically constructed and which can be quickly and easily assembled or disassembled from the ceiling or floor support for the partition. The partition is stabilized at both the top, bottom and intermediate portions thereof, and the wall can accommodate, with little modification, doors or windows therealong. The wall assembly is therefore very adaptable to varying design requirements, and the entire wall can be relocated with minimal effort where interior design patterns are desired to be changed. Due to the relatively tight fitting of the upper and lower ends of the panels in the ceiling and floor runners, respectively, and the pressure pad assembly in the vertically intermediate regions of the wall, the second transmission through the walls is greatly reduced. At the same time, since no vertical studs are necessary, substantial free space is provided between the wall panels to accommodate wiring and other service equipment.

I claim:

1. A demountable partition assembly comprising a. an integrally formed ceiling runner rigidly attached to an upper supporting surface, said ceiling runner including a base, a pair of downwardly extending outer legs, and a pair of outwardly and downwardly inclined inner legs, each outer leg and adjacent inner leg defining a space therebetween;

b. a pair of wall panels at either side of said partition assembly and forming the exposed wall surfaces thereof, the upper end of each panel being removably positioned in said ceiling runner, said panels being spaced and thereby providing a substantially open area therebetween for accommodating wiring, piping and the like;

c. a floor runner comprising a base, a pair of outer legs having upwardly and downwardly extending leg portions, and a pair of outwardly and upwardly inclined inner legs, the upper portion of each outer leg and the adjacent inner leg defining a space therebetween, said ceiling and floor runners being spaced so as to exceed in dimension the vertical dimension of said wall panels whereby said panels when installed can first be raised upwardly in said ceiling runner and thereafter lowered so that the bottom edges of said panels engage said base of said floor runner, and d. means for supporting and laterally stabilizing said floor runner and thus said partition wall from a supporting surface, said supporting means serving as the sole support for said partition assembly, said means for supporting and laterally stabilizing said floor runner and thus said partition walls comprising a leveling block disposed within the downwardly extending portions of said outer legs of said floor runner, and a floor strip positioned within said outer legs below said leveling block, said floor strip being spaced from the supporting surface for the partition assembly by nail means extending downwardly through said floor strip into engagement with said supporting surface, whereby said floor strip and thus said partition assembly can be installed over carpet without significant damage thereto, said downwardly extending portions of said outer legs of said floor runner terminating adjacent the upper surface of the carpet whereby said outer legs function as finish trim members.

2. The partition assembly of claim 1 wherein said ceiling and floor runners are formed of plastic material, and said wall panels are disposed in resilient tight engagement between said outer and said inner legs in said ceiling and floor runners.

3. The partition assembly of claim 1 wherein said wall panels are formed with grooves in the top and bottom edges thereof, said grooves receiving said outer legs of said ceiling and floor runners when said wall panels are mounted thereon.

4. The partition assembly of claim 1 further including a pressure pad assembly mounted in the vertically intermediate region of one of said wall panels, said pressure pad assembly including a resilient pad adapted to resiliently engage the adjoining face of the opposed wall panel thereby to space and stabilize the panels in such region of the partition and to reduce sound transmission through said partition in such region.

5. The partition assembly of claim 1 wherein said means for supporting said floor runner further includes shim means disposed between said leveling block and said floor strip for leveling said block and thus said floor runner.

6. The partition assembly of claim 1 further including a door and mounting means therefor in said partition assembly, said mounting means including a door header having projecting portions received in said spaces between said outer and inner legs of said ceiling runner, and means for securing said header to said ceiling runner, and door jamb means at either side of the door opening rigidly interconnected to the adjoining wall panels.

7. The partition assembly of claim 6 wherein said means for mounting said door header to said ceiling runner comprises a header block positioned within said ceiling runner between said inclined inner legs, and fastening means securing said door header to said header block, the mounted position of said door header preventing disassembly of said header block from said ceiling runner.

8. The partition assembly of claim 1 further including a window and mounting frame therefor disposed along said wall, said mounting frame including a window header having projecting portions received in the spaces between said outer and inner legs of said ceiling runner, and means for securing said window header to said ceiling runner, a window base formed with projections extending into the spaces defined by said outer and inner legs of said floor runner, and means for securing said window base to said floor runner, and window jamb members disposed at either side of the window opening, said window jamb members being rigidly interconnected to said adjoining wall panels.

9. The partition assembly of claim 8 wherein said means for mounting said window header and window base on said ceiling and floor runners, respectively, comprise block members retained within and between said inner legs of said floor and ceiling runners, and fastening means extending through said window header and base members into secure engagement with said block members, the projecting portions of said window header and base members precluding withdrawal of said block members from their mounted positions.

10. A demountable partition assembly comprising a. a ceiling runner rigidly attached to an upper supporting surface, said ceiling runner including a base, a pair of downwardly extending outer legs, and a pair of outwardly and downwardly inclined inner legs, each outer leg and adjacent inner leg defining a space therebetween;

b. a pair of wall panels at either side of said partition assembly and forming the exposed wall surfaces thereof, the upper end of each panel being removably positioned in said ceiling runner, said panels being spaced and thereby providing a substantially open area therebetween for accommodating wiring, piping and the like;

c. a floor runner comprising a base, a pair of outer legs, and a pair of outwardly and upwardly inclined inner legs, the upper portion of each outer leg and the adjacent inner leg defining a space therebetween, said ceiling and floor runners being spaced so as to exceed in dimension the vertical dimension of said wall panels whereby said panels when installed can first be raised upwardly in said ceiling runner and thereafter lowered so that the bottom edges of said panels engage said base of said floor runner, d. means for supporting and laterally stabilizing said floor runner and thus said partition wall from a supporting surface, said supporting means serving as the sole support for said partition assembly, and e. a door and mounting means therefor in said partition assembly, said mounting means including a door header having projecting portions received in said spaces between said outer and inner legs of said ceiling runner, and means for securing said header to said ceiling runner, and door jamb means at either side of the door opening rigidly interconnected to the adjoining wall panels.

11. The partition assembly of claim 10 wherein said means for mounting said door header to said ceiling runner comprises a header block positioned within said ceiling runner between said inclined inner legs, and fastening means securing said door header to said header block, the mounted position of said door header preventing disassembly of said header block from said ceiling runner.

12. A demountable partition assembly comprising a. a ceiling runner rigidly attached to an upper supporting surface, said ceiling runner including a base, a pair of downwardly extending outer legs, and a pair of outwardly and downwardly inclined inner legs, each outer leg and adjacent inner leg defining a space therebetween;

b. a pair of wall panels at either side of said partition assembly and forming the exposed wall surfaces thereof, the upper end of each panel being removably positioned in said ceiling runner, said panels being spaced and thereby providing a substantially open area therebetween for accommodating wiring, piping and the like;

c. a floor runner comprising a base, a pair of outer legs, and a pair of outwardly and upwardly inclined inner legs, the upper portion of each outer leg and the adjacent inner leg defining a space therebetween, said ceiling and floor runners being spaced so as to exceed in dimension the vertical dimension of said wall panels whereby said panels when installed can first be raised upwardly in said ceiling runner and thereafter lowered so that the bottom edges of said panels engage said base of said floor runner, d. means for supporting and laterally stabilizing said floor runner and thus said partition wall from a supporting surface, said supporting means serving as the sole support for said partition assembly, and e. a window and mounting frame therefor disposed along said wall, said mounting frame including a window header having projecting portions received in the spaces between said outer and inner legs of said ceiling runner, and means for securing said window header to said ceiling runner, a window base formed with projections extending into the spaces defined by said outer and inner legs of said floor runner, and means for securing said window base to said floor runner, and window jamb members disposed at either side of the window opening, said window jamb members being rigidly interconnected to said adjoining wall panels.

13. The partition assembly of claim 12 wherein said means for mounting said window header and window base on said ceiling and floor runners, respectively, comprise block members retained within and between said inner legs of said floor and ceiling runners, fastening means extending through said window header and base members into secure engagement with said block members, the projecting portions of said window header and base members precluding withdrawal of said block members from their mounted positions.

14. A demountable partition assembly comprising a. a celing runner rigidly attached to the upper supporting surface for the partition assembly, said ceiling runner being formed with a base and downwardly extending outer legs;

b. a pair of wall panels at either side of said partition assembly and forming the exposed wall surfaces thereof, said panels being spaced and thereby providing a substantially open area therebetween for accommodating wiring, piping and the like, each of said panels being formed with grooves in the top and bottom edges thereof, said outer legs of said ceiling runner extending into said grooves in the top edges of said panels when the latter are mounted, and c. a floor runner formed with a generally horizontal base and outer legs extending upwardly and downwardly at the outer edges of said base, said outer legs of said floor runner extending into the grooves in the bottom edges of said panels when the latter are mounted, the bases of said ceiling and floor runners being spaced so as to exceed in dimension the vertical dimension of said wall panels whereby said panels when installed can first be raised upwardly by virtue of said slots toward the base of said ceiling runner and thereafter lowered so that the bottom edges of said panels engage said base of said floor runner, and d. means for supporting and laterally stabilizing said floor runner and thus said partition wall from a supporting surface, said supporting means serving as the sole support for said partition assembly, said means for supporting and laterally stabilizing said floor runner and thus said partition walls comprising a leveling block disposed within the downwardly extending outer legs of said floor runner, and a floor strip positioned within said outer legs below said leveling block, said floor strip being spaced from the supporting surface for the partition assembly by nail means extending downwardly through said floor strip into engagement with said supporting surface, whereby said floor strip and thus said partition assembly can be installed over carpet without significant damage thereto, downwardly extending portions of said outer legs of said floor runner terminating adjacent the upper surface of the carpet whereby said outer legs function as finish trim members.

15. The partition assembly of claim 14 further including a pressure pad assembly mounted in the vertically intermediate region of one of said wall panels, said pressure pad assembly including a resilient pad adapted to resiliently engage the adjoining face of the opposed wall panel thereby to space and stabilize the panels in such region of the partition and to reduce sound transmission through said partition in such region.

16. The partition assembly of claim 14 wherein the adjoining edges of each wall panel are provided with mating grooves to form a shiplap-type joint, such joint being tightened by the pressure applied by said pressure pad assembly.

17. The partition assembly of claim 14 wherein said means for supporting said floor runner further includes shim means disposed between said leveling block and said floor strip for leveling said block and thus said floor runner.

18. The partition assembly of claim 14 further including a door and mounting means therefor in said partition assembly, said mounting means including a door header received in said space between said outer legs of said ceiling runner, means for securing said header to said ceiling runner, and door jamb means at either side of the door opening rigidly interconnected to the adjoining wall panels.

19. The partition assembly of claim 14 further including a window and mounting frame therefor disposed along said wall, said mounting frame including a window header received between said outer legs of said ceiling runner, and means for securing said window header to said ceiling runner, a window base received in the space between said outer legs of said floor runner, means for securing said window base to said floor runner, and window jamb members disposed at either side of the window opening, said window jamb members being rigidly interconnected to said adjoining wall panels.

* * * * *